US007300036B2

(12) United States Patent
Dinius

(10) Patent No.: US 7,300,036 B2
(45) Date of Patent: Nov. 27, 2007

(54) PULLEY AND HOIST ADAPTER FOR BOLTS ALL-THREAD RODS

(76) Inventor: Michael J. Dinius, 5971 S. Oaklands Dr., Tucson, AZ (US) 85746

( * ) Notice: Subject to any disclaimer, the term of this patent is extended or adjusted under 35 U.S.C. 154(b) by 41 days.

(21) Appl. No.: 11/315,436

(22) Filed: Dec. 22, 2005

(65) Prior Publication Data

US 2006/0169959 A1 Aug. 3, 2006

Related U.S. Application Data

(63) Continuation-in-part of application No. 10/795,177, filed on Mar. 5, 2004, now abandoned.

(51) Int. Cl.
*B66F 3/00* (2006.01)

(52) U.S. Cl. ..... 254/233

(58) Field of Classification Search ..... 254/231, 254/233, 234; 248/317, 200, 300, 309.1, 248/309.2

See application file for complete search history.

(56) References Cited

U.S. PATENT DOCUMENTS

| | | | |
|---|---|---|---|
| 3,832,782 | A | 9/1974 | Johnson et al. |
| 4,010,942 | A | 3/1977 | Ward |
| 4,062,519 | A | 12/1977 | Jacobs |
| 4,078,470 | A | 3/1978 | Zeranick et al. |
| 4,183,440 | A | 1/1980 | Wilkinson |
| 4,236,399 | A | 12/1980 | Williams et al. |
| 4,367,862 | A | 1/1983 | McGregor |
| 4,380,872 | A | 4/1983 | Moran |
| 4,455,013 | A | 6/1984 | Fischer et al. |
| 4,462,731 | A | 7/1984 | Rovinsky et al. |
| 4,619,475 | A | 10/1986 | Sylvest, II |
| 5,205,543 | A | 4/1993 | Thiede |
| 5,226,687 | A | 7/1993 | Currie |
| 5,338,015 | A | 8/1994 | Liegel et al. |
| 5,439,264 | A | 8/1995 | Margiottiello |
| 5,518,220 | A | 5/1996 | Bertrand et al. |
| 5,570,758 | A | 11/1996 | Nussbaum |
| 5,590,865 | A | 1/1997 | Odom, Jr. |
| 5,788,198 | A | 8/1998 | Sharpe |
| 5,816,564 | A | 10/1998 | Winter |
| 5,992,802 | A | 11/1999 | Campbell |
| 6,124,935 | A | 9/2000 | Matthews |
| 6,457,692 | B1 | 10/2002 | Gohl, Jr. |
| 6,516,728 | B1 | 2/2003 | Muller et al. |
| 6,568,095 | B2 | 5/2003 | Snyder |
| 6,666,298 | B2 | 12/2003 | Volkman |

FOREIGN PATENT DOCUMENTS

| | | |
|---|---|---|
| EP | 0 205 343 | 12/1986 |
| EP | 0 688 687 | 12/1995 |
| EP | 0 852 460 | 7/1998 |

*Primary Examiner*—Emmanuel M Marcelo
(74) *Attorney, Agent, or Firm*—Quarles & Brady LLP; Gavin J. Milczarek-Desai

(57) ABSTRACT

A hoist or pulley adapter that fits upon an elevated "all thread" type rod or a threaded bold. The adapter includes engagement means that are adapted to receive the all thread or threaded bolt and are connected to a support member featuring an eyelet or similar opening structure to support a rope or pulley.

7 Claims, 6 Drawing Sheets

PULLEY AND HOIST ADAPTER FOR BOLTS ALL-THREAD RODS

CROSS REFERENCE TO RELATED APPLICATIONS

This application claims priority to, and is a continuation-in-part of, U.S. patent application Ser. No. 10/795,177 filed on Mar. 5, 2004, now abandoned by the same inventor.

BACKGROUND

1. Field of the Invention

The invention relates in general to the field of lifting mechanisms and more particularly to an adapter that engages a threaded rod and is especially useful for creating a hoist or pulley system.

2. Description of the Related Art

Hoists, pulleys, "come alongs," and the like have been known for centuries as simple mechanisms for exerting mechanical leverage over a lift load. Yet, most improvements to such mechanisms have involved the means for exerting leverage (e.g., a pulley) or the means for attaching the load to be lifted to the line (e.g., a rope) so as to adapt the hoist to lift specialized articles.

Indeed, U.S. Pat. No. 4,619,475 by Sylvest, II discloses an apparatus for lifting drums with a crane or the like. Essentially, the apparatus consists of beam that grasps or clamps onto the annular lips found at the end of oil drum containers so as to provide a safer means for engaging the same.

Campbell (U.S. Pat. No. 5,992,802) discloses a cable support for parallel runs of coaxial cable that is made up of pairs of molded blocks that are stacked on a single threaded rod. The blocks of each pair are identical and have semi-circular cylindrical recesses that cooperate to provide circular, cable-gripping passages. However, Campbell does not teach or suggest providing a hoist or adapter for making a hoist.

Fischer et al. (U.S. Pat. No. 4,455,013) disclose a hoist that has a piston and cylinder combination connected to a slidable sheave set for moving the sheave and an engaged rope. Thus, a load attached to the end of the rope may be lifted. To prevent the rope from rising or falling too quickly, a braking system is engaged if the piston goes above a pre-selected speed limit (thereby, for example, preventing the lifted load from accidentally falling abruptly and causing injury).

In view of the above, it would be desirable to have an adapter that is simple and durable, that can be used with a variety of lines and pulleys, and that can convert a threaded rod into a hoist or pulley system.

SUMMARY OF THE INVENTION

The invention relates to an adapter that threadedly engages an "all thread" type rod or a threaded bolt that protrudes from elevated position (e.g., a ceiling area), with the adapter further having an eyelet or similar structure from which a pulley or hoist line may be hung. Preferably, the adapter of the invention includes a first and a second engagement means for threadedly engaging a threaded rod, wherein the first and the second engagement means are connected to the support member such that the threaded rod is axially aligned between said engagement means.

Also, the engagement means may include semi-circular hex nuts (i.e., hex nuts that have been cut in half) so that the adapter may be secured to the threaded rod without having to screw the adapter on at the rod's end. In other words, the adapter can be attached to the rod at any point along the rod where there is clearance to do so, thereby avoiding scaffolding or other obstacles that could impair attachment if the adapter had to be secured by threading it on at an end of the rod.

In another embodiment of the invention, the adaptor includes a "pincer-" or "ice tong-like" structure having an engagement means and a eyelet structure at opposing ends of the adaptor, two primary arms joined by a pivot pin, and two secondary arms attached to one primary arm by a second pivot pin. Once the engagement means is secured to the threaded bolt or rod and weight disposed upon the eyelet structure, the arms are pulled downwardly and create a clamping effect of the adaptor to the bolt or rod.

Thus, it is a primary objective of the invention to provide a hoist or pulley adapter that is simple to use in a variety of locations.

Further, an object of the invention is to provide a hoist or pulley adapter that can be secured on a threaded rod or threaded bolt along the body of the rod or bolt rather then threading it on the end to avoid obstacles that may be present near the rod or bolt end.

Another object of the invention is to provide a hoist or pulley adapter that is portable such that it can be easily moved or even carried by a workman in, for example, a tool box.

Still another object of the invention is to provide a hoist or pulley adapter that is simple and inexpensive to manufacture.

In accordance with these and other objects there is provided a new and improved adapter that fits upon an "all thread" type rod or a threaded bold that protrudes from an elevated location, with the adapter preferably having two semi-cylindrical channels that are adapted to receive the all thread and are connected to a bracket or support member featuring an eye bolt or similar opening structure to support a rope or pulley.

Various other purposes and advantages of the invention will become clear from its description in the specification that follows. Therefore, to the accomplishment of the objectives described above, this invention includes the features hereinafter fully described in the detailed description of the preferred embodiments, and particularly pointed out in the claims. However, such description discloses only some of the various ways in which the invention may be practiced.

DETAILED DESCRIPTION OF THE PREFERRED EMBODIMENTS

The invention involves a adapter that fits upon an "all thread" rod or a threaded bold that protrudes from an elevated location, with the adapter preferably having two semi-circular nuts that are adapted to receive the all thread and are connected to a bracket or support member featuring an eye bolt or similar structure to support a rope or pulley.

Many "industrial ceilings," such as a ceiling in a boiler room and so forth, have threaded rods (e.g., all-thread rods or threaded bolts) that protrude from a scaffolding near or in the ceiling. The adapter of the invention engages the threaded rod (such as by twisting or screwing) and provides an opening to which a pulley or line may be attached, thereby creating a convenient and secure hoist with which heavy loads may be lifted in a particular location.

Preferably, the adapter of the invention is made from metal such as steel and contains at least one engagement means for attachment to a threaded rod. The engagement means may be custom made to fit upon a rod of a particular diameter according to the needs of the user.

Figure 1:
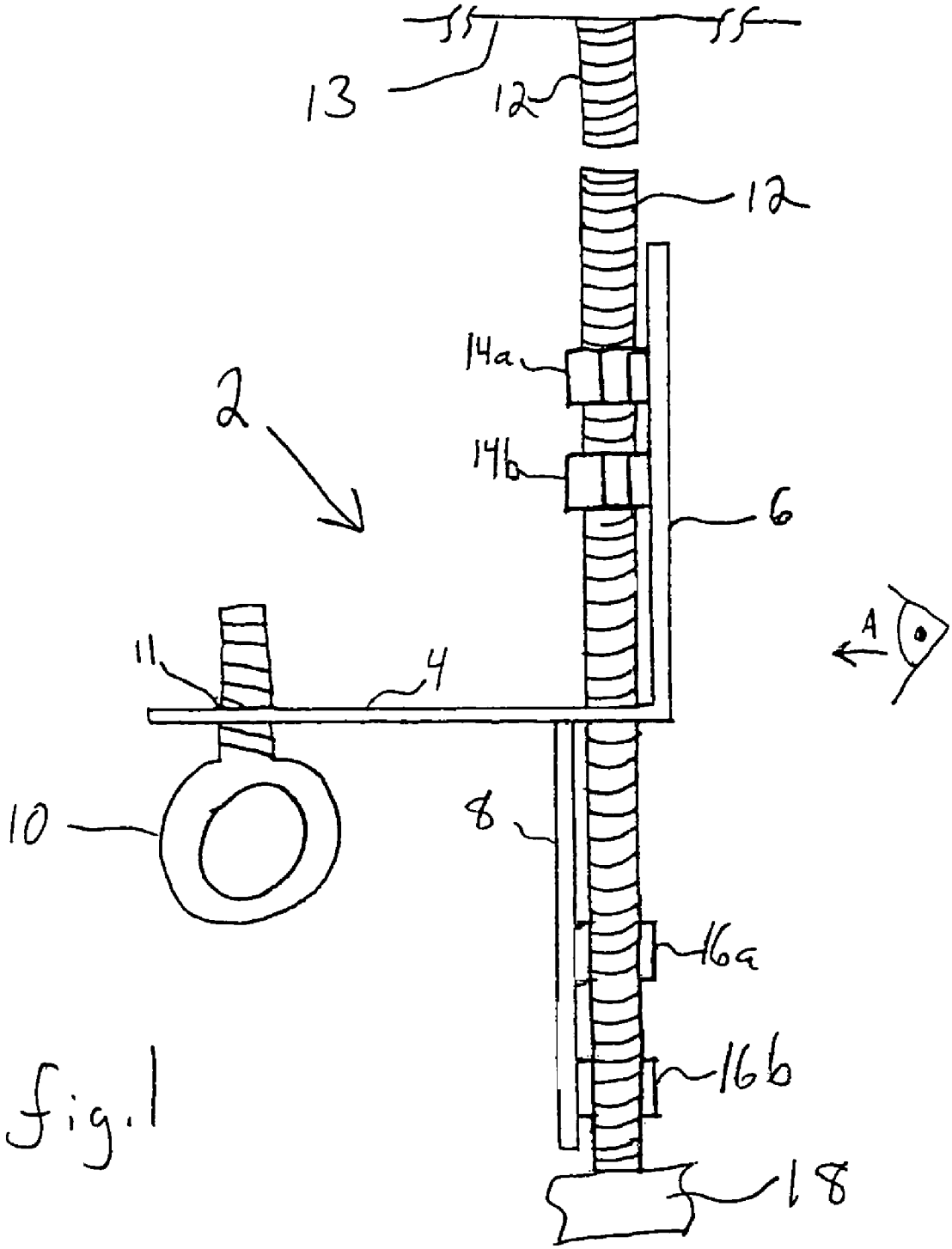
FIG. 1 is a schematic, side elevational view of a first embodiment of the invention.

Turning to FIG. 1, a schematic side elevational view of a preferred embodiment of the invention is shown. The adapter 2 features a support bracket 4 that includes a first vertical member 6 and a second vertical member 8. Disposed through a hole 11 in the support bracket 4 is an eye bolt 10. A line or pulley (not shown) may be threaded through or attached, respectively, to the eye bolt 10.

The adapter axially engages a threaded rod 12 attached to a ceiling 13 (or other elevated structure) through engagement means that are disposed on vertical members 6 and 8 such that the engagement means are in perpendicular arrangement with rigid support member 4. Thus, in this embodiment, semi-circular hex nuts 14*a* and 14*b* are connected to vertical member 6 and semi-circular hex nuts 16*a* and 16*b* are connected to vertical member 8. Hex nuts 14*a* and 14*b* are disposed on vertical member 6 to be offset from the location of hex nuts 16*a* and 16*b* on vertical member 8, with the result being that the threaded rod 12 can be axially engaged between each pair of hex nuts as shown. Thus, the adapter 2 is secured in place on threaded rod 12 by twisting or screwing the adapter 2 around so that it threadedly engages the rod through hex nuts 14*a*, 14*b*, 16*a*, and 16*b*.

Another feature of the embodiment of the invention shown in FIG. 1 is that the adapter 2 can be secured to the rod 12 even if there is a blockage at or near the end of the rod, such as scaffolding 18. In other words, the adapter 2 can be used to create a hoist even if the ends of a threaded rod are inaccessible.

Figure 2:
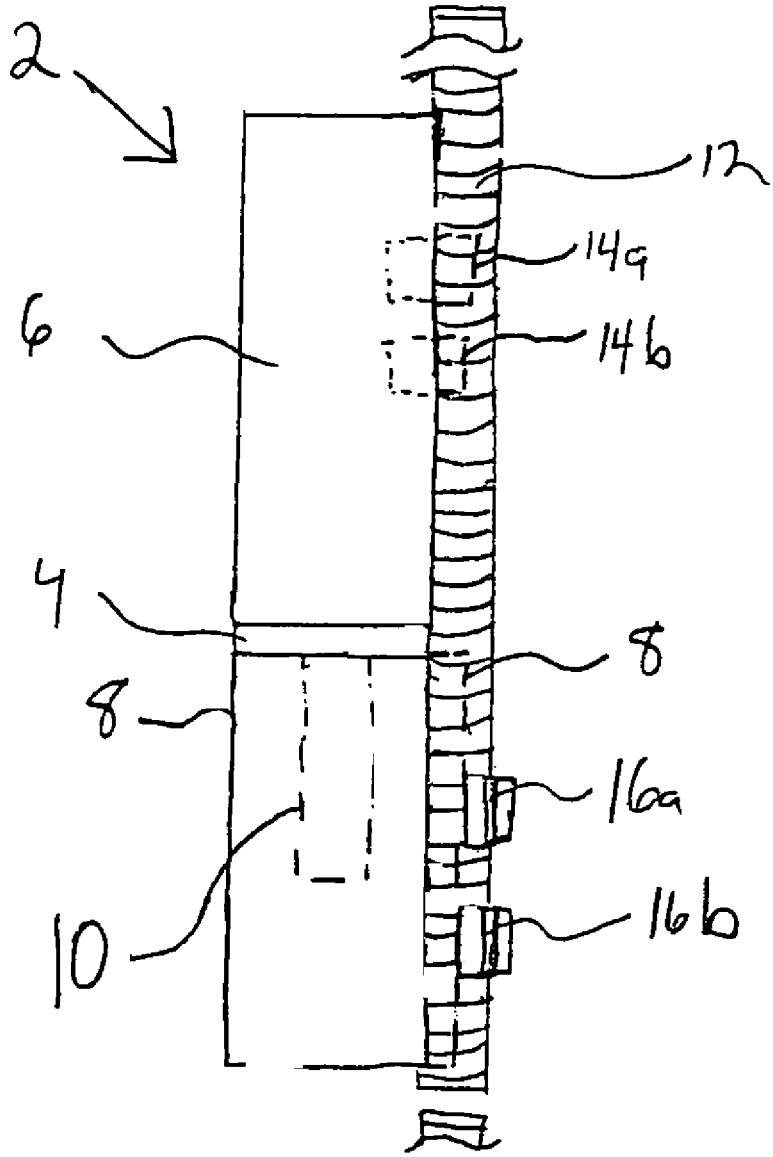
FIG. 2 is a schematic, front elevational view of the embodiment shown in FIG. 1 as taken from the direction indicated by arrow A.

Turning to FIG. 2, a front view of the same embodiment illustrated in FIG. 1 is shown. This figure further illustrates how hex nuts 14*a* and 14*b* are offset from hex nuts 16*a* and 16*b* (note that vertical member 8 is partially shown in phantom line) so that the threaded rod 12 can be accommodated and engaged thereby. A side view of eye bolt 10 also is shown in phantom line for completeness.

Figure 3:
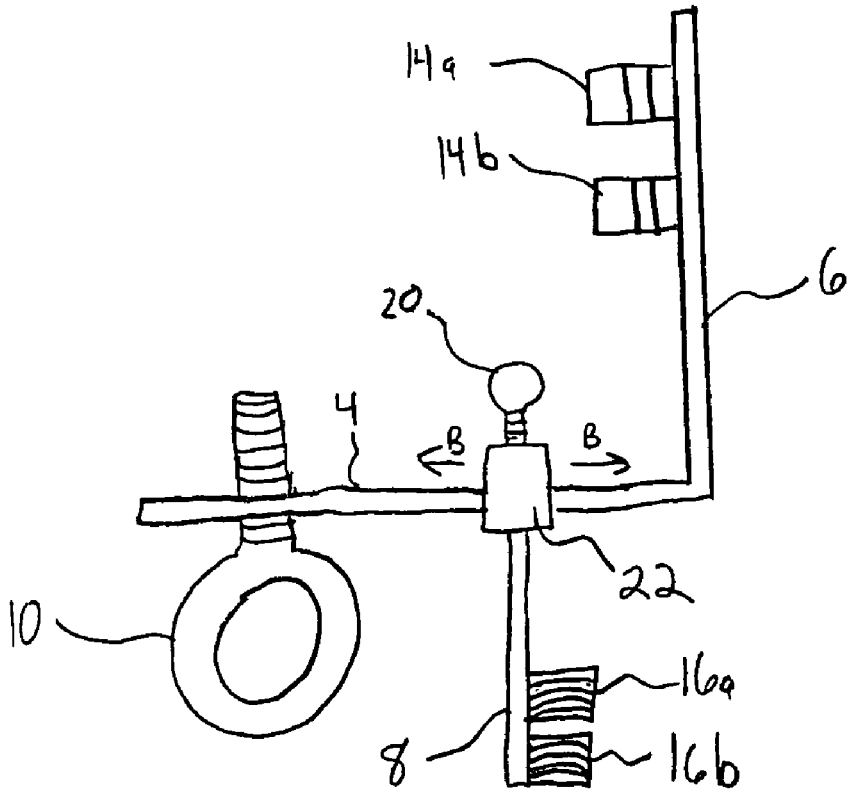
FIG. 3 is a schematic, side elevational view of a second embodiment of the invention featuring a slidably adjustable all-thread rod engagement means.

In FIG. 3, an adjustable embodiment of the invention is shown. Here, thumb screw 20 may be rotated upward in block 22 so as to disengage support member 4 for the purpose of sliding block 22 and the attached vertical member 8 along support member 4 as shown by arrows B. Once eyebolt 10 is removed from support 4, vertical member 8 can be slid completely off the adapter 4. Moreover, a different (e.g., longer or thicker) vertical member with the same size hex nuts as 16*a* and 16*b* can be substituted for member 8 if greater stability or other functional variation in the adapter 2 is desired.

Figure 4:
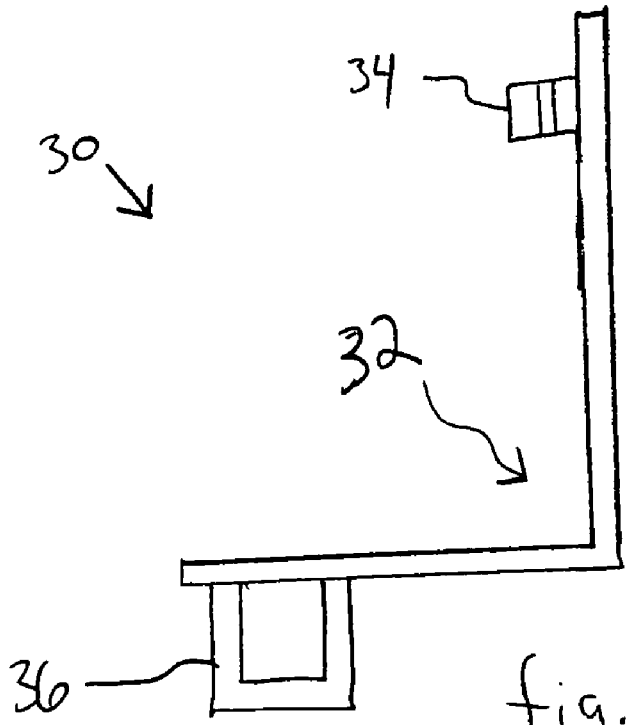
FIG. 4 is a schematic, side elevational view of a third embodiment.

FIG. 4 shows an alternative embodiment of the invention that features an adapter 30 having an L-shaped bracket 32, a means for engagement 34 on one end of the L-shaped bracket, and an eyelet structure 36 on the other end. The engagement means 34 may comprise a hex or other nut capable of threading around a threaded rod so as to securely engage the rod (not shown).

Figure 5:
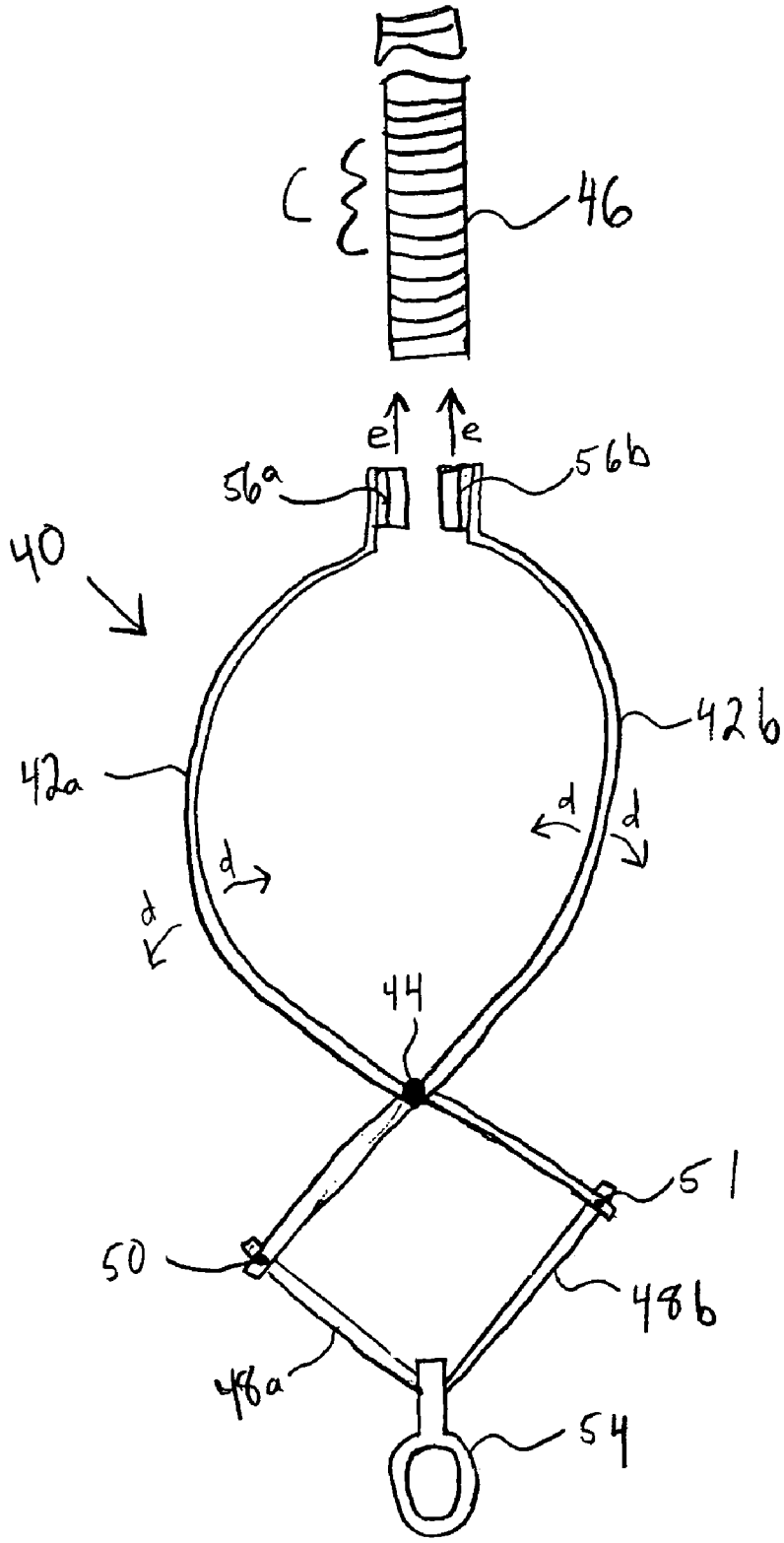
FIG. 5. is a schematic, front elevational view of a forth embodiment of the invention.

FIG. 5 shows a second alternative embodiment of the invention that features an "ice tong-like" structure. The adapter 40 includes a first primary arm 42*a* and a second primary arm 42*b* connected by pivot pin 44, which allows each arm to move back-and-fourth (and thereby "open" and "close" around threaded rod 46) as indicated by arrows d. Primary arms 42*a* and 42*b* are further connected to secondary arms 48*a* and 48*b* by pivot pins 50 and 51. Attached to each secondary arm is an eyelet structure, which in this case is an eye bolt 54. At the opposite end of arms 42*a* and 42*b* are engagement means 56*a* and 56*b*. The engagement means 56*a* and 56*b* may be semi-circular hex nuts, which threadedly engage a complimentary threaded rod 46 as twisting or screwing motion is applied to the adapter 40.

While adapter 40 could be threaded onto the end of rod 46 as indicated by arrows e, the arms 42*a* and 42*b* also can be adjusted to allow for the adapter at to be "clamped" onto threaded rod 46 at, for example, location c. Initially the engagement means 56*a* and 56*b* secure the adapter 40 to the rod 46. However, the application of weight to the eye bolt 54 will increase the "clamping effect" of the adapter as gravity pulls the arms 42*a*, 42*b*, 48*a* and 48*b* downwardly.

Figure 6:
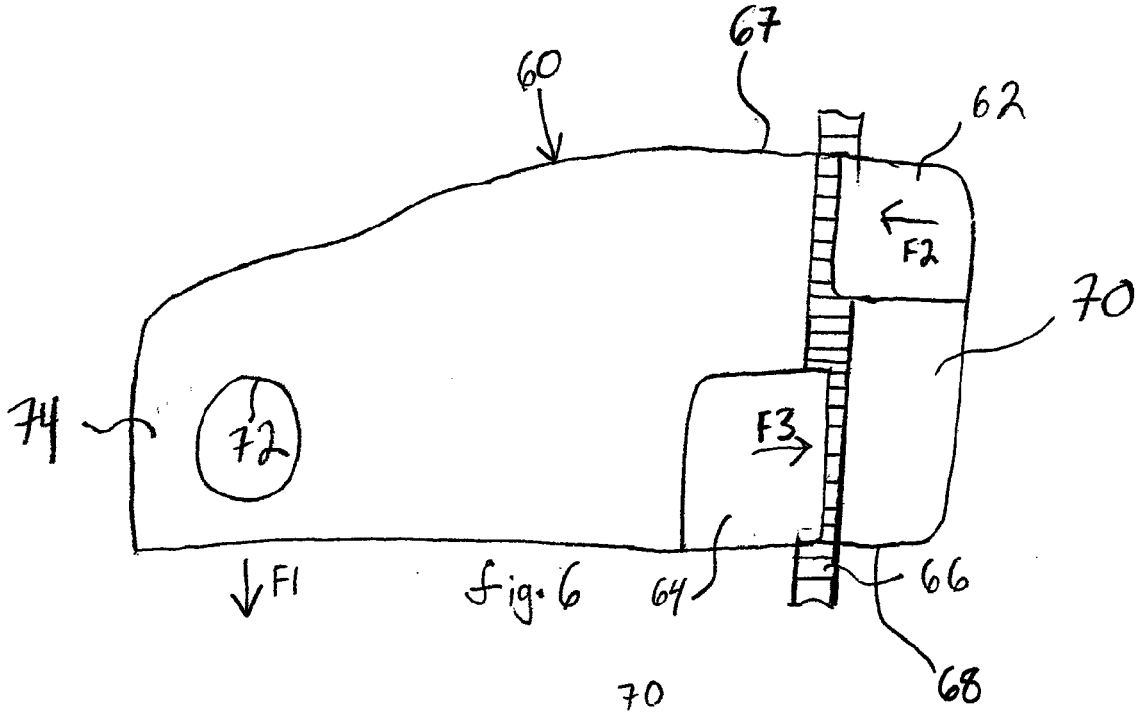
FIG. 6 is an elevational side view of a fifth embodiment of the invention.

Turing to FIG. 6, another embodiment of the invention featuring a single, unitary structure (so-called "unibody construction") is illustrated. A rigid support member 60 includes a first engagement means 62 and a second engagement means 64 aligned such that a threaded rod 66 is axially engaged therebetween. As shown, the first engagement means 62 is located along the top edge 67 and the second engagement means 64 is located along the bottom edge 68. Both engagement means are located proximal to a first end 70 of the support member 60, while an opening 72 is disposed proximal to a second end 74 of the support member 60.

Preferably, the first engagement means and the second engagement means are disposed in an offset arrangement such that a downward force (arrow F1) acting on the support member 60 further urges the first and second engagement means into frictional contact with the threaded rod 66, as indicated by arrows F2 and F3. This action produces an especially desirable clamping effect between the engagement means and the threaded rod when downward force is applied near or on the opening 72 (such as by a rope or pulley placed therethrough).

Figure 7:
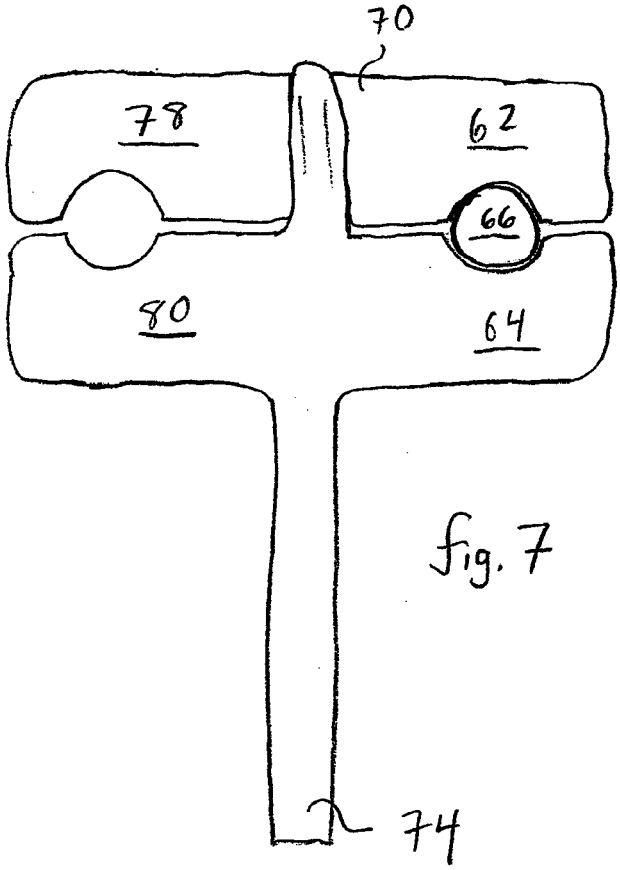
FIG. 7 is bottom view of the embodiment shown in FIG. 6.

As seen in from a top view perspective in FIG. 7, the adapter shown in FIG. 6 preferably includes a support member 60 further having a third engagement means 78 and a forth engagement means 80 disposed substantially symmetric with the first and second engagement means (62 and 64) on an opposite side of the support member 60. Thus, two threaded rods (not shown) may be engaged simultaneously.

Figure 8:
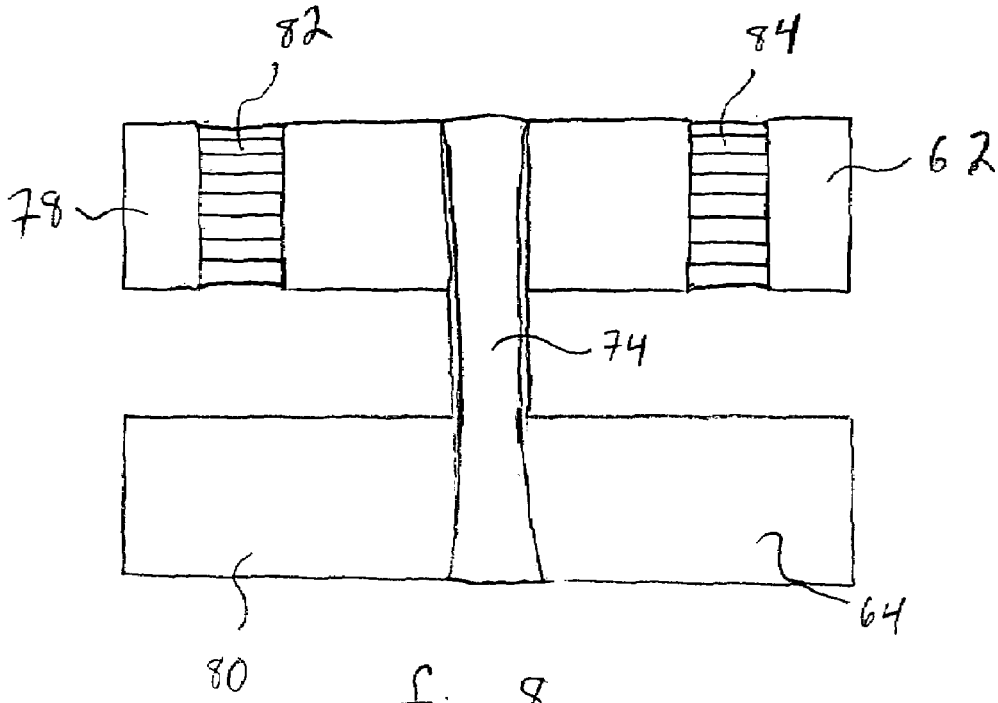
FIG. 8 is front elevational view of the embodiment illustrated in FIG. 6.

Turning to FIG. 8, a frontal view of the embodiment featured in FIGS. 6 and 7 is shown. In this view, the first and second engagement means more clearly can be seen to include hemi-cylindrical channels 82 and 84 positioned to engage a threaded rod on opposite sides thereof.

Figure 9:
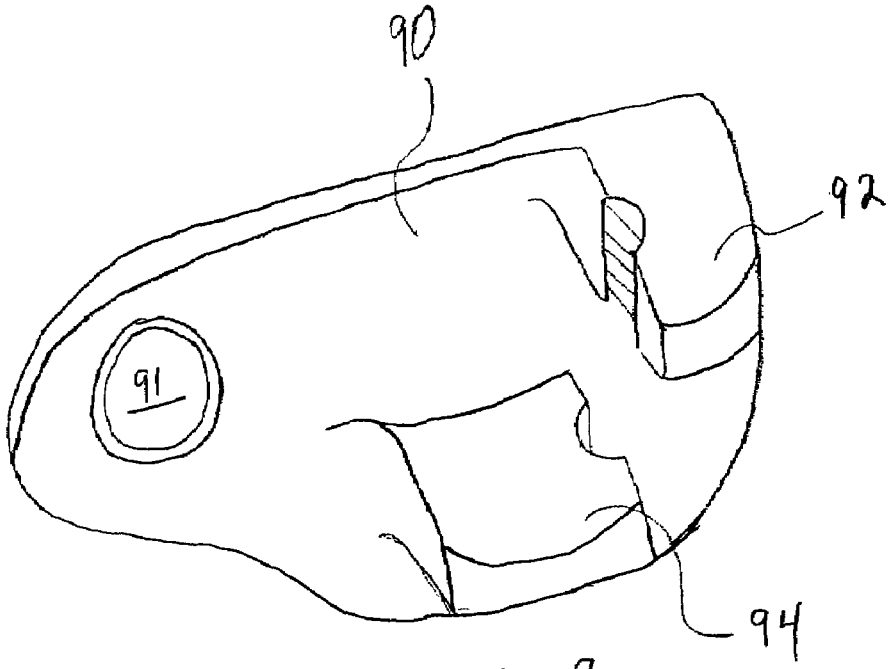
FIG. 9 is perspective view of a sixth embodiment of the invention.

FIG. 9 illustrates another embodiment of the invention in perspective view. The rigid support member 90 includes an opening 91 disposed thereon, a first engagement means 92, and a second engagement means 94, with the first and second engagement means being adapted to engage a threaded rod and disposed upon the support member 90 such that a threaded rod may be axially engaged therebetween.

A method for converting an elevated threaded rod into a hoist thusly is easily practiced by providing the rigid support member such that the threaded rod is axially engaged between the engagement means and securing the rigid support member to the threaded rod by rotating the engagement means of the adapter around the threaded rod. Alternatively, the support member may simply be "clamped" to the threaded rod by providing a downward force upon the support member as described above. Furthermore, a line or pulley may be coupled with the opening of the rigid support member to provide a hoist.

An alternate method includes the step of providing an adapter for securing a hoist or pulley mechanism to a threaded rod, the adapter including a rigid support member, an eyelet structure connected to and extending downwardly from the rigid support member, and an engagement means for reversibly engaging said threaded rod. The engagement means is connected to the support member such that the threaded rod is axially disposed through said engagement means. Thus, securing the adapter to said threaded rod is accomplished easily by rotating the adapter around the rod until firmly mounted.

Various changes in the details and components that have been described may be made by those skilled in the art within the principles and scope of the invention herein described in the specification and defined in the appended claims. For example, different size nuts may be used in the invention to provide engagement means on an adapter that fit upon different diameter rods or bolts. Therefore, while the present invention has been shown and described herein in what is believed to be the most practical and preferred embodiments, it is recognized that departures can be made therefrom within the scope of the invention, which is not to be limited to the details disclosed herein but is to be accorded the full scope of the claims so as to embrace any and all equivalent processes and products.

I claim:

1. An adapter for securing a hoist or pulley mechanism to a threaded rod, comprising:

a rigid support member;

a first engagement means and a second engagement means aligned such that said threaded rod is axially engaged between said first and second engagement means, and said first and second engagement means are located proximal to a first end of said support member; and an opening disposed upon said support member and located proximal to a second end of said support member, wherein said first engagement means is disposed along a top edge of said support member and said second engagement means is disposed below said first engagement means and in offset arrangement such that a downward force acting on said opening of said support member further urges said first and second engagement means into frictional contact with said threaded rod.

2. The adapter of claim 1, wherein said rigid support member and said first and second engagement means are a single, unitary structure.

3. The adapter of claim 1, wherein said rigid support member, said first and second engagement means, and said opening are a single, unitary structure.

4. The adapter of claim 1, wherein said support member further includes a third and a forth engagement means disposed on an opposite side of said support member and substantially symmetric with said first and second engagement means.

5. An adapter for securing a hoist or pulley mechanism to a threaded rod, comprising:

a rigid support member;

a first engagement means and a second engagement means aligned such that said threaded rod is axially engaged between said first and second engagement means, and said first and second engagement means are located proximal to a first end of said support member; and an opening disposed upon said support member and located proximal to a second end of said support member, wherein said first and second engagement means comprise hemi-cylindrical channels positioned to engage said threaded rod in opposite sides thereof.

6. A method for converting an elevated threaded rod into a hoist, comparing the steps of:

(a) providing a rigid support member having a first engagement means and a second engagement means aligned such that said threaded rod is axially engaged between said first and second engagement means, said first and second engagement means are located proximal to a first end of said support member, and an opening disposed upon said support member and located proximal to a second end of said support member; and (b) securing the rigid support member to said threaded rod, wherein the rigid support member is secured to the threaded rod by clamping said first and second engagement means to said threaded rod through application of downward force upon said support member.

7. The method of claim 6, further comprising the step of attaching a line or pulley to the opening of said rigid support member.

* * * * *

UNITED STATES PATENT AND TRADEMARK OFFICE

CERTIFICATE OF CORRECTION

PATENT NO. : 7,300,036 B2
APPLICATION NO. : 11/315436
DATED : November 27, 2007
INVENTOR(S) : Michael J. Dinius It is certified that error appears in the above-identified patent and that said Letters Patent is hereby corrected as shown below:

Claim 6, line 2, delete "comparing" and insert -- comprising --.

Signed and Sealed this

Eighteenth Day of March, 2008

JON W. DUDAS
*Director of the United States Patent and Trademark Office*

UNITED STATES PATENT AND TRADEMARK OFFICE

CERTIFICATE OF CORRECTION

PATENT NO. : 7,300,036 B2
APPLICATION NO. : 11/315436
DATED : November 27, 2007
INVENTOR(S) : Michael J. Dinius It is certified that error appears in the above-identified patent and that said Letters Patent is hereby corrected as shown below:

Column 6, Claim 6, line 36, delete "comparing" and insert -- comprising --.

This certificate supersedes the Certificate of Correction issued March 18, 2008.

Signed and Sealed this

Fifteenth Day of April, 2008

JON W. DUDAS
*Director of the United States Patent and Trademark Office*